United States Patent [19]

Komiya

[11] 4,436,410

[45] Mar. 13, 1984

[54] IMAGE FORMING APPARATUS

[75] Inventor: Yutaka Komiya, Tokyo, Japan

[73] Assignee: Canon Kabushiki Kaisha, Tokyo, Japan

[21] Appl. No.: 368,675

[22] Filed: Apr. 15, 1982

[30] Foreign Application Priority Data

Apr. 20, 1981 [JP] Japan ..... 56-58585

[51] Int. Cl.[3] ..... G03G 15/01; G03G 15/04

[52] U.S. Cl. ..... 355/14 E; 355/4; 355/69

[58] Field of Search ..... 355/14 E, 14 R, 4, 69, 355/55, 56, 57, 60, 71

[56] References Cited

U.S. PATENT DOCUMENTS

| | | | |
|---|---|---|---|
| 3,748,036 | 7/1973 | Ogawa | 355/69 |
| 4,264,188 | 4/1981 | Tomosada et al. | 355/14 R |
| 4,278,334 | 7/1981 | Maeda | 355/69 X |

*Primary Examiner*—Richard L. Moses

*Attorney, Agent, or Firm*—Fitzpatrick, Cella, Harper & Scinto

[57] ABSTRACT

A color image forming apparatus having a variable magnification ratio copy function has a controller which controls a voltage applied to an exposure lamp in accordance with a given magnification ratio and a selected one of a plurality of color filters which are sequentially selected to be inserted in an optical path of a reflected light from an original. Color copies of correct color balance are produced for any magnification ratio.

11 Claims, 10 Drawing Figures

IMAGE FORMING APPARATUS

BACKGROUND OF THE INVENTION

1. Field of the Invention

The present invention relates to a light intensity controller for a color image forming apparatus, and more particularly to an image forming apparatus for making a color copy by forming electrostatic latent images based on color images of an original produced by color decomposition.

2. Description of the Prior Art

In a prior art copying machine having a variable magnification ratio copy function, in order to compensate for the change in a light intensity per unit area for different magnification ratios, a magnification of an optical system is changed in accordance with the magnification ratio and an effective voltage to a light exposure lamp (halogen lamp) is changed in accordance with the magnification to adjust the light intensity.

However, it has been known that when the effective voltage to the halogen lamp is changed, not only a color temperature, a current and a light emitting efficiency of the lamp change but also a peak wavelength shifts to a red region and hence an energy distribution also shifts. Accordingly, when the light intensity is adjusted simply in accordance with the magnification ratio, a color balance of the color copying machine is lost.

SUMMARY OF THE INVENTION

It is an object of the present invention to provide an image forming apparatus capable of forming color images of the same color tone independently of the change in a lamp voltage.

It is another object of the present invention to provide an image forming apparatus which controls a light intensity in accordance with a selected filter and a selected magnification ratio.

The above and other objects of the present invention will be apparent from the following description of the present invention.

DETAILED DESCRIPTION OF THE PREFERRED EMBODIMENTS

Figure 1:
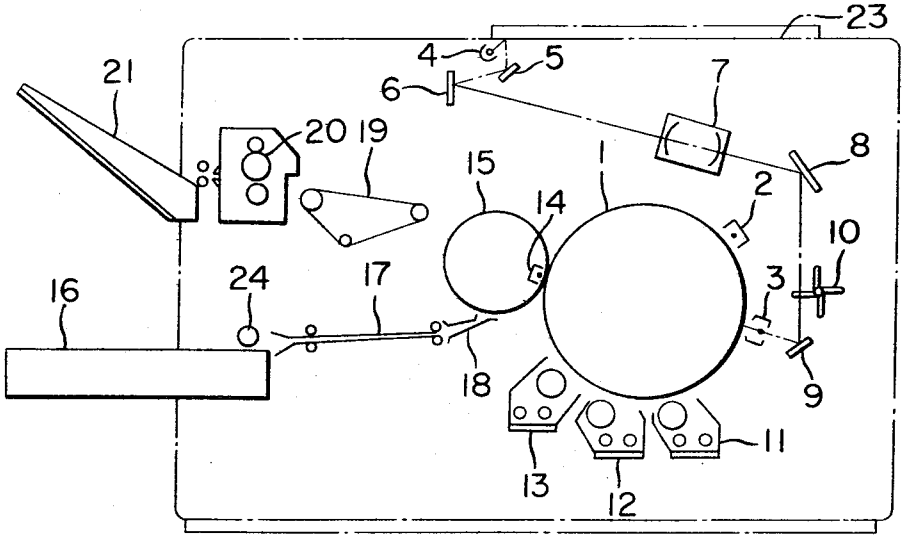
FIG. 1 shows a construction of a color image forming apparatus.

FIG. 1 shows a schematic construction of a color copying machine. Numeral 1 denotes a photosensitive drum on which a latent image of an original is formed. An entire surface of the photosensitive drum 1 is uniformly charged by a primary charger 2 prior to light exposure. The latent image is formed on the charged photosensitive drum 1 in accordance with an image of the text (not shown) mounted on an original table 23.

The original is illuminated by an illumination lamp 4 and a reflected light is focused onto the photosensitive drum 1 through mirrors 5 and 6, a variable magnification lens system 7 and mirrors 8 and 9, and the charges on the drum 1 are discharged by a secondary charger 3 to form the electrostatic latent image of the original. The reflected light from the original passes through a spectro-filter 10 comprising blue (B), green (G), red (R) and gray (ND) filters. The blue filter is first inserted into the optical path so that an electrostatic latent image for a blue component of the text is formed, and it is developed by a yellow developer 11 and an image for the blue component is formed on a record paper (not shown) mounted on a transfer drum 15 through a transfer charger 14. The record paper is fed to the transfer drum 15 from a paper cassette 16 through guides 17 and 18 and held there by a gripper (not shown). Thereafter, the green filter and the red filter are sequentially inserted into the optical path and electrostatic latent images for the green and red components of the original are formed on the drum 1. They are developed by a magenta developer 12 and a cyan developer 13, respectively, and transferred to the record paper mounted on the transfer drum 15 in a registered relationship to each other. The record paper having the images for the respective color components recorded thereon is then moved off the gripper and fed to a fixing station 20 through a conveyer belt 19, where it is fixed and then ejected to an ejection tray 21. In case of a magnification ratio copy, the mirrors 5, 6, 8 and 9 and the variable magnification lens 7 are positioned to keep a specified positional relationship so that the copy is made at the specified magnification ratio.

Figure 2:
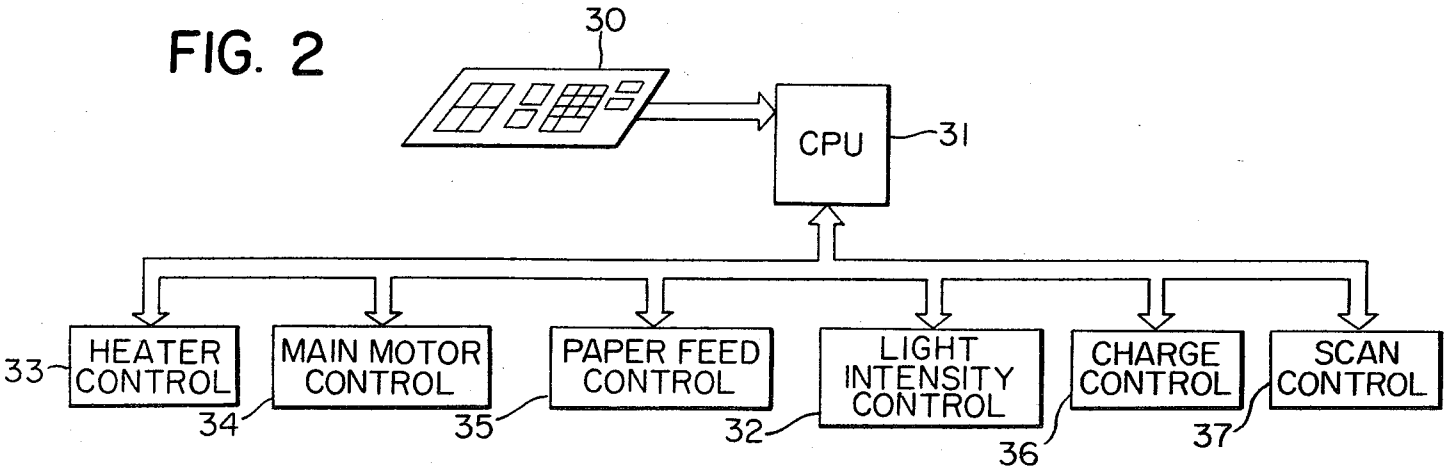
FIG. 2 shows a block diagram of a controller for the color image forming apparatus shown in FIG. 1.

Such a color copying machine is controlled by a controller shown in FIG. 2. When a magnification ratio is entered by a control panel 30 to a central processing unit (CPU) 31 which may be a well-known microcomputer, the CPU calculates, based on the magnification ratio data, light intensities for the respective color filters and transmits the data to a light intensity control 32. When a COPY ON signal is then entered by the control panel 30 to the CPU 31, the CPU 31 controls a heater control 33 which controls a temperature of the fixing station 20, a main motor control 34 which controls a main motor which is a drive source for the respective units, a paper feed control 35 which controls a paper feed roll 24 to feed a paper from the paper cassette 16, a charge control 36 which controls the respective chargers, a scan control 36 which controls the scan of the optical system to expose light to the original, and the light intensity control 32 which controls the light intensity of the exposure lamp 4, for each color filter in accordance with an electrographic process to make a color copy.

Figure 3:
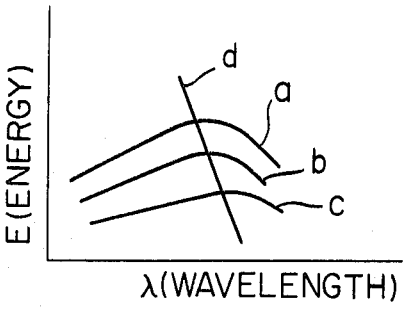
FIG. 3 shows a characteristic curve of an energy distribution for a lamp voltage.

In a prior art apparatus, the light intensity compensation for the different magnification ratio has been carried out by changing the light intensity of the exposure lamp 4 in accordance with the magnification ratio, as described above. The light intensity is changed by changing the effective voltage to the lamp by phase control or voltage control. However, as shown in FIG. 3, when the voltage is dropped, the energy-frequency characteristic of the halogen lamp 4 changes as shown by curves a, b and c and a peak wavelength changes to follow a line d. That is, the peak wavelength changes toward a long wavelength region, and the red ratio of an energy distribution of a visual sensitivity band also decreases. Accordingly, in the color copying machine which makes a color copy by decomposing the light to the respective color components by the spectrofilter, those deviations must be compensated.

The compensation method is now described. The lamp voltage is determined by calculating a light flux distribution of the halogen lamp. A calculation method using a concept of light flux is herein explained. Let us assume that a range of wavelength of a visible region under consideration is between $\lambda_1$ and $\lambda_2$, boundaries of the color filters B, G and R are $\lambda_{BG}$ and $\lambda_{GR}$, light intensities in unity magnification ratio when the filters B, G and R are used are $F_B$, $F_G$ and $F_R$ and a magnification ratio is M, then, $$MF_B = \int_{\lambda_1}^{\lambda_{BG}} f_B(\lambda) \cdot S(\lambda) d\lambda$$

$$MF_G = \int_{\lambda_{BG}}^{\lambda_{GR}} f_G(\lambda) \cdot S(\lambda) d\lambda$$

$$MF_R = \int_{\lambda_{GR}}^{\lambda_2} f_R(\lambda) \cdot S(\lambda) d\lambda$$

where $f_B$, $f_G$ and $f_R$ are light flux distributions and $S(\lambda)$ is a drum sensitivity. Thus, the halogen lamp voltage is controlled such that the light flux distributions $f_B(\lambda)$, $f_G(\lambda)$ and $f_R(\lambda)$ which make the ratios of the light intensities for the respective filters for a given magnification ratio equal to the ratios of the light intensities for the respective filter for the unity magnification ratio are obtained. If transmission of the optical system and the color filters are frequency dependent, they are stored in the CPU as parameters and they are considered in the calculation so that correct halogen lamp voltages are calculated.

Figure 4:
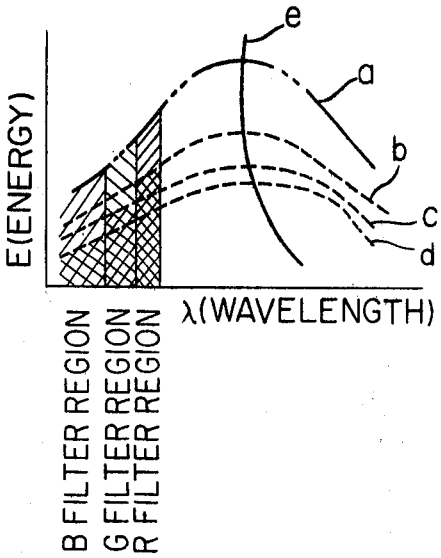
FIG. 4 illustrates a light intensity compensation in accordance with the present invention.

FIG. 4 shows characteristics after the compensation in accordance with the present invention. A curve a depicts an energy distribution for the unity magnification ratio copy, and curves b, c and d depict energy distributions after the light intensity compensation for the given magnification ratio for the filters B, G and R. The ratios of the light flux distributions for the blue, green and red regions are equal to those for the unity magnification ratio copy. That is, the ratios of the areas ①, ② and ③ are equal to the ratios of the double hatched areas ①' ②' and ③' for the filters B, G and R. In this manner, the integrations of the light intensities transmitted through the filters B, G and R are adjusted to keep a correct color balance, taking the drum sensitivity into consideration, so that a high quality of color copy of the given magnification ratio is produced.

Figure 5:
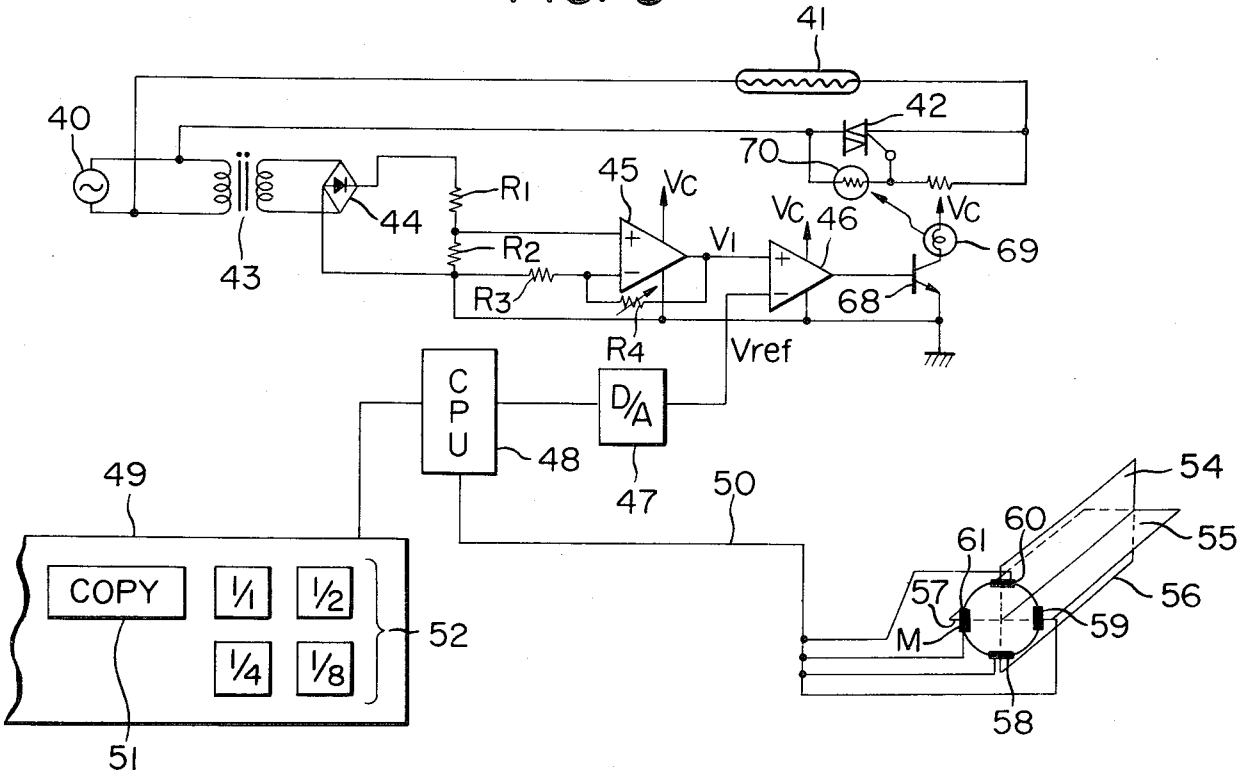
FIG. 5 shows one embodiment of a light intensity compensation circuit in accordance with the present invention.

The above method is implemented by an apparatus shown in FIG. 5. In FIG. 5, an A.C. power supply 40 is connected to a light exposure lamp 41 (corresponding to 4 in FIG. 1) through a TRIAC 42. The power supply voltage is transformed by an A.C. voltage detecting transformer 43 and the transformed voltage is full-wave rectified by a full-wave rectifying diode bridge 44 to which resistors $R_1$ and $R_2$ are connected. Numeral 45 denotes an operational amplifier. A voltage divided by the resistors $R_1$ and $R_2$ is applied to a non-inverting input terminal of the operational amplifier 45 and an inverting input terminal is grounded through an input resistor $R_3$. The operational amplifier 45 has a feedback resistor $R_4$ and forms a feedback amplifier having a gain of $R_4/R_3$, and an output voltage $V_1$ thereof is supplied to a non-inverting input terminal of a succeeding stage operational amplifier 46. An output from a D/A converter 47 is applied to an inverting input terminal of the operational amplifier 46 as a reference voltage $V_{ref}$.

The D/A converter 47 converts the digital signal from a well-known one-chip microcomputer (e.g. NEC μPD545) CPU 48 (corresponding to 31 in FIG. 1) having a ROM and a RAM therein, to an analog signal. The CPU 48 receives a signal 53 from a keyboard 49 and a signal 50 indicating a filter position. The keyboard 49 has a copy button 51 and magnification specifying keys 52, and the signal 53 indicating the selected magnification ratio is applied to the CPU 48. A filter B 54, a filter G 55, a filter R 56 and a filter ND 57 are sequentially selected and the filter position is sensed by a mark M by sensors 58–61 and stored in the CPU 48 through the signal line 50. The CPU 48 stores therein a spectro-sensitivity of the drum and calculates the light intensity for the selected magnification ratio and color filter in accordance with the formula descirbed above.

The calculated value is converted to an analog signal by the D/A converter 47 and the analog signal is supplied to the inverting input terminal of the operational amplifier 46 as the reference voltage $V_{ref}$. As the reference voltage $V_{ref}$ changes with the selected magnification ratio and color filter, a duty period of the operational amplifier 46 changes and a transistor 68 is activated for the duty period so that a light emitting device 69 emits light. The light emitted is sensed by a photosensitive device 70 so that the TRIAC 42 conducts for that period to control the voltage applied to the exposure lamp 41.

Figure 6A:
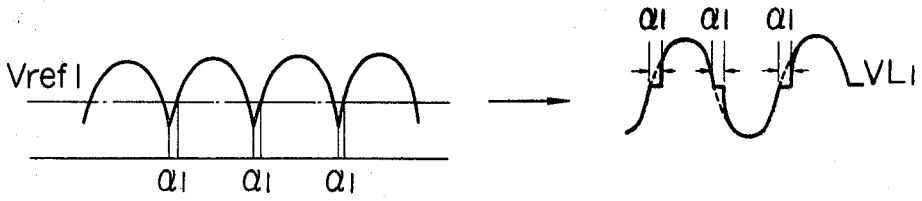
FIGS. 6A and 6B show lamp voltage waveforms.
Figure 6B:
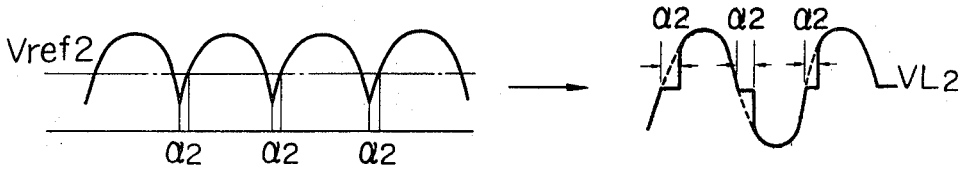

FIGS. 6A and 6B show phase cut angles $\alpha_1$ and $\alpha_2$ and lamp voltages $VL_1$ and $VL_2$ when the reference voltage is set to $V_{ref1}$ and $V_{ref2}$, respectively. In this manner, the lamp voltage is controlled.

Figure 7:
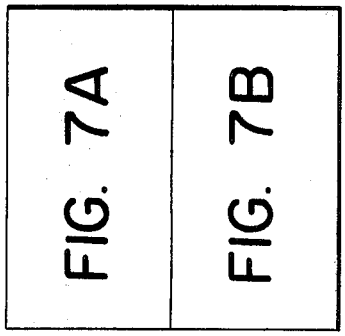
FIGS. 7A and 7B show a control flow chart in accordance with the present invention.
Figure 7A:
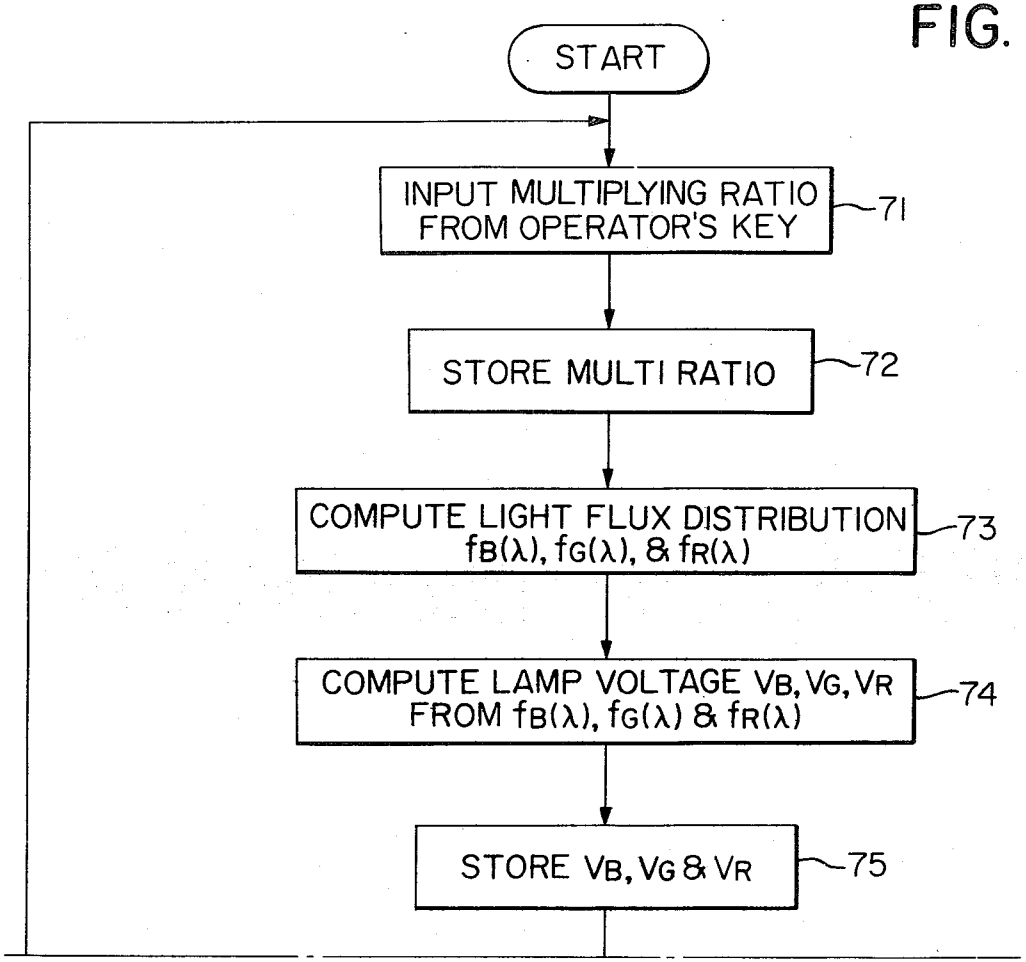
Figure 7B:
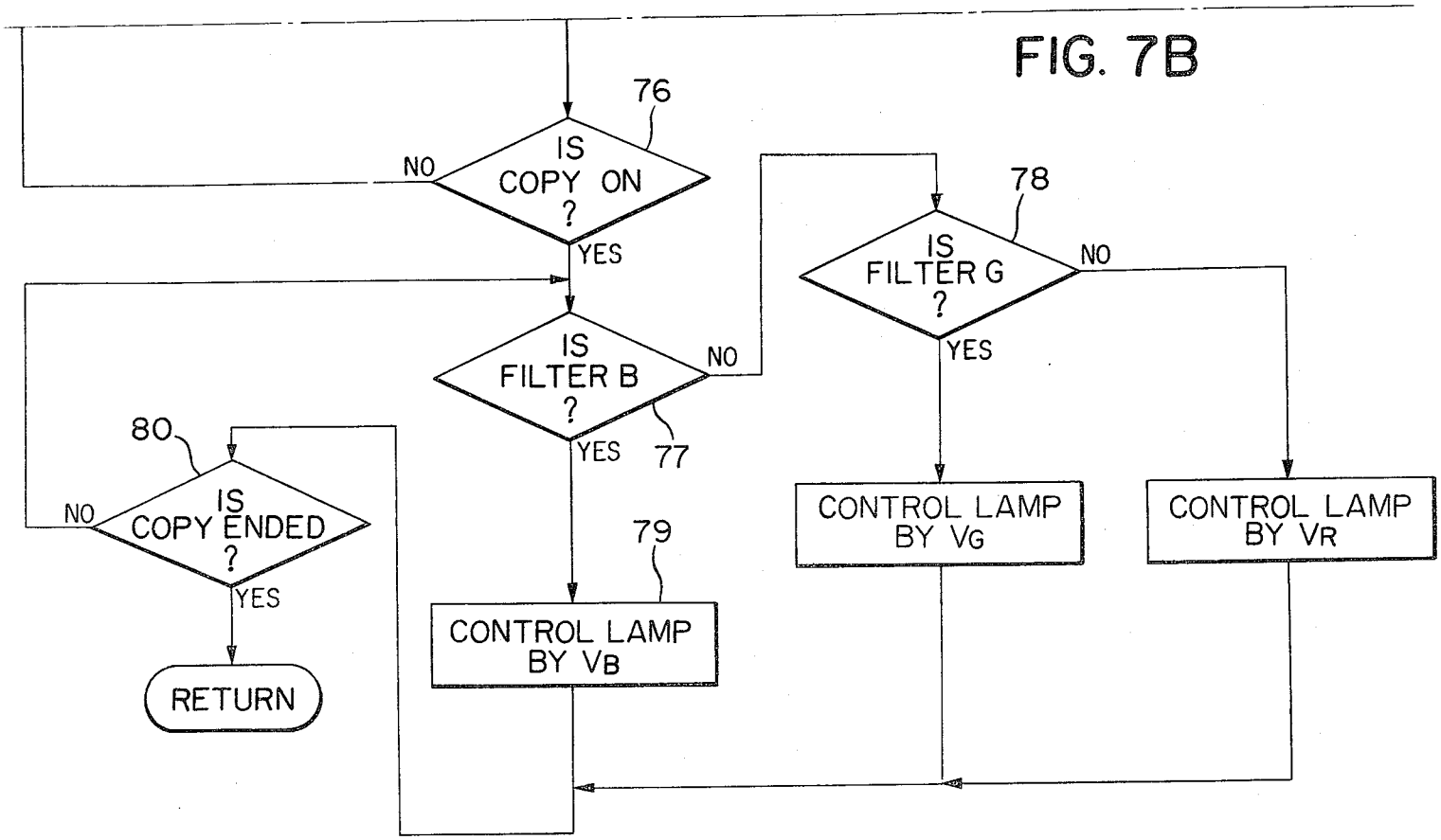

The control flow is now explained with reference to FIG. 7. In a step 71, a desired magnification ratio is set by the key 52 and the data thereof is stored in the RAM of the CPU 48 (step 72). In a step 73, light flux distributions which satisfies $MF_B = MF_G = MF_R$ are calculated, taking the magnification ratio and the drum sensitivity into consideration, and in a step 74 the lamp voltages for the respective color filters are calculated based on the calculated $f_B(\lambda)$, $f_G(\lambda)$ and $f_R(\lambda)$. In a step 75, the lamp voltages $V_B$, $V_G$ and $V_R$ for the respective color filters are stored, and in a step 76 a copy start status is checked. In a COPY ON state, the selection of the filter B, G or R is determined (steps 77, 78) and the lamp voltage is controlled in accordance with the selected filter by the stored lamp voltage $V_B$, $V_G$ or $V_R$. In a step 80, the number of copies is checked and if a desired number of copies has not been made, the process goes back to the step 77.

As described above, according to the present invention, the light intensities for the respective color images are controlled in accordance with the selected magnification ratio and color filter, and in the magnification ratio copy mode, the light intensity is compensated, taking the shift of the frequency-energy characteristic of the exposure lamp into consideration to keep a correct color balance. Accordingly, color images of the same color tone can be reproduced for any magnification ratio.

The present invention is applicable not only to the lamp voltage control for the variable magnification ratio copy but also to the lamp voltage control in controlling the density of the image.

The present invention is also applicable to a color image forming apparatus using lamps having spectrosensitivities instead of using the color filters.

What I claim is:

1. An image forming apparatus comprising:

image forming means for forming an image on a record medium, said image forming means including a lamp for exposing an original;

mode selection means for selecting a color mode from a plurality of image formation modes which may be formed on said record medium;

voltage selection means for selecting a voltage applied to said lamp to change a light intensity of said lamp in accordance with another said mode for image formation; and control means for controlling the applied voltage in accordance with said voltage selection means and said mode selection means.

2. An image forming apparatus according to claim 1, wherein said mode selection means selects a blue, green or red filter.

3. An image forming apparatus according to claim 1, wherein said voltage selection means responds to means for selecting a magnification ratio of the image formed on said record medium.

4. A color image forming apparatus having a variable magnification ratio copy function comprising:

specifying means for specifying a magnification ratio of an image to be formed on a record medium;

image forming means for forming a color image on said record medium at the magnification ratio specified by said specifying means, said image forming means including exposure means for exposing an original, a plurality of spectrometric means for selection to color-decompose light from said original, and image processing means for forming said color image according to said selection; and control means for controlling a condition of one of said image forming means in accordance with the magnification ratio specified by said specifying means and the selected color.

5. A color image forming apparatus according to claim 4, wherein said plurality of spectrometric means are blue, green and red filters.

6. A color image forming apparatus according to claim 4, wherein said control means controls the light intensities of said exposure means such that ratios of the light intensities for the respective spectrometric means in a given magnification ratio copy mode are equal to those in a unity magnification ratio copy mode.

7. A color image forming apparatus according to claim 4, wherein said control means includes detection means for detecting which one of said plurality of spectrometric means has been selected.

8. A color image forming apparatus having a variable magnification ratio copy function comprising:

specifying means for specifying a magnification ratio of an image to be formed on a record medium;

image forming means for forming a color image on said record medium at the magnification ratio specified by said specifying means, said image forming means including exposure means for exposing an original and a plurality of spectrometric means for selection to color-decompose light from said original; and control means for controlling said exposure means in accordance with the magnification ratio specified by said specifying means and the selected one of said plurality of spectrometric means, wherein said control means corrects the light intensity by controlling a voltage applied to said exposure means.

9. A color image forming apparatus according to claim 8 wherein said control means controls a conduction angle of the applied voltage.

10. A color image forming apparatus having a variable magnification ratio copy function comprising:

specifying means for specifying a magnification ratio of an image to be formed on a recording medium;

image forming means for forming a color image on said record medium at the magnification ratio specified by said specifying means, said image forming means including exposure means for exposing an original and a plurality of spectrometric means for color-decomposing a reflected light from said original; and control means for controlling said exposure means in accordance with the magnification ratio specified by said specifying means and the selected one of said plurality of spectrometric means, wherein said control means controls the light intensities of said exposure means such that ratios of the light intensities for the respective spectrometric means in a given magnification ratio copy mode are equal to those in a unity magnification ratio copy mode, and wherein said control means corrects the light intensity by controlling a voltage applied to said exposure means.

11. A color image forming apparatus according to claim 10, wherein said control means controls a conduction angle of the applied voltage.

* * * * *